US007520144B2

(12) United States Patent
Ciccone

(10) Patent No.: US 7,520,144 B2
(45) Date of Patent: Apr. 21, 2009

(54) SINGLE EARRING SET FOR DOUBLE PIERCED EARS

(76) Inventor: Gerald A. Ciccone, 482 Cabain Rd., Jackson, NJ (US) 08527

( * ) Notice: Subject to any disclaimer, the term of this patent is extended or adjusted under 35 U.S.C. 154(b) by 0 days.

(21) Appl. No.: 11/756,862

(22) Filed: Jun. 1, 2007

(65) Prior Publication Data

US 2008/0022720 A1 Jan. 31, 2008

Related U.S. Application Data

(60) Provisional application No. 60/810,795, filed on Jun. 2, 2006.

(51) Int. Cl.
*A44C 7/00* (2006.01)

(52) U.S. Cl. ..... 63/13; 63/12

(58) Field of Classification Search ..... None
See application file for complete search history.

(56) References Cited

U.S. PATENT DOCUMENTS 4,086,786 A 5/1978 Ritter
4,489,572 A 12/1984 Wilczewski
4,512,112 A 4/1985 LeVine
4,854,132 A 8/1989 Blumkin et al.
D324,350 S 3/1992 Owens, Jr.
D348,023 S 6/1994 Horner et al.
D376,768 S 12/1996 Ross
D410,589 S 6/1999 Lagergren
6,014,870 A 1/2000 Horner et al.
6,568,212 B2 5/2003 Jacobs
2005/0279135 A1 * 12/2005 Marcovitch et al. ..... 63/12

* cited by examiner

*Primary Examiner*—Jack W. Lavinder
(74) *Attorney, Agent, or Firm*—Gotlieb, Rackman & Reisman

(57) ABSTRACT

An earring assembly for doubled pierced ear is provided. The assembly includes a first element comprising a first linkage, a middle element comprising a second linkage and third element comprising a third linkage. The first linkage of the first element has first and second ends. Similarly, the second linkage of the middle element has first and second ends and the third linkage of the third element has first and second ends. Corresponding ends of the linkages are attached utilizing post and back mating connections in order to attach the earring assembly to a wearer's earlobe.

20 Claims, 4 Drawing Sheets

FIG. 4A
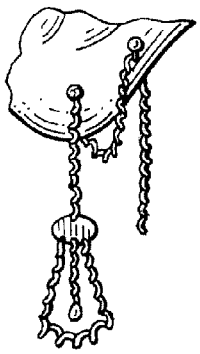
FIG. 4B
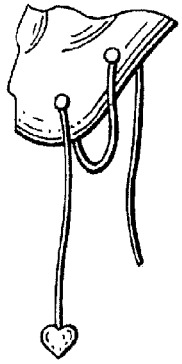
FIG. 4C
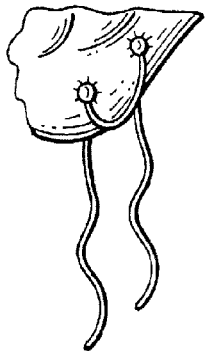
FIG. 4D
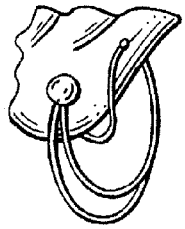
FIG. 4E
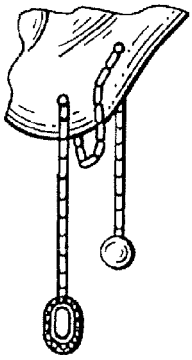
FIG. 4F
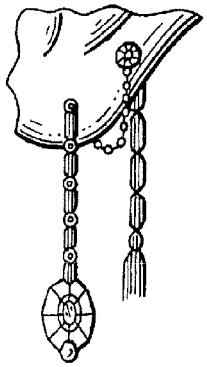
FIG. 4G
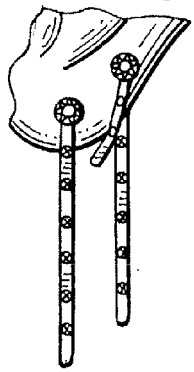
FIG. 4H
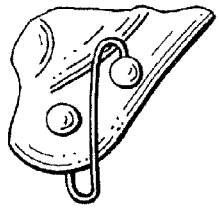
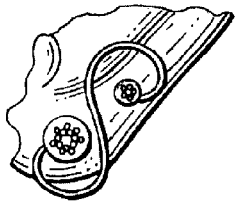
FIG. 4I
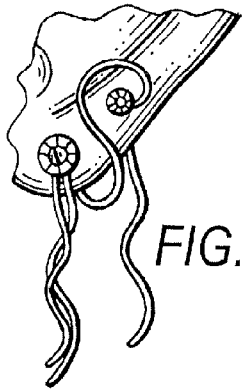
FIG. 4J
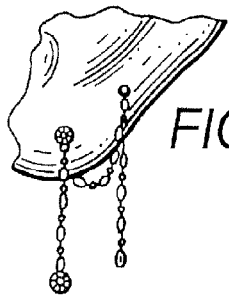
FIG. 4K
FIG. 4L
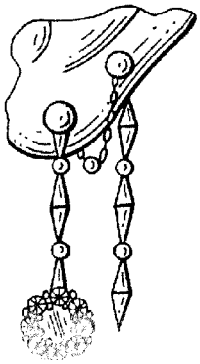
FIG. 4M
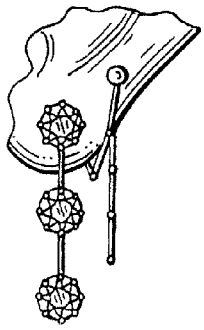
FIG. 4N
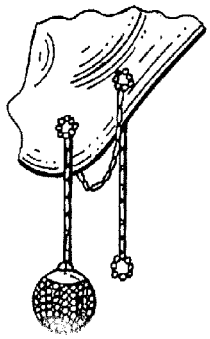
FIG. 4O
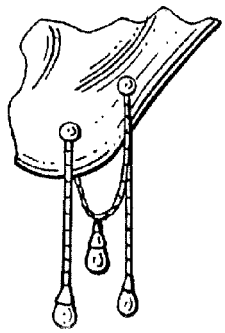

FIG. 5A
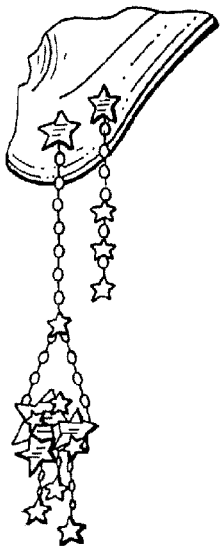
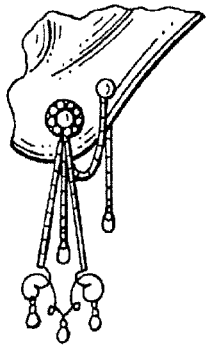
FIG. 5B
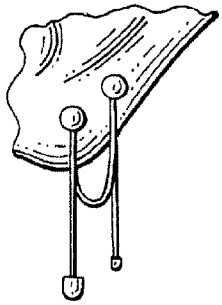
FIG. 5C
FIG. 5D
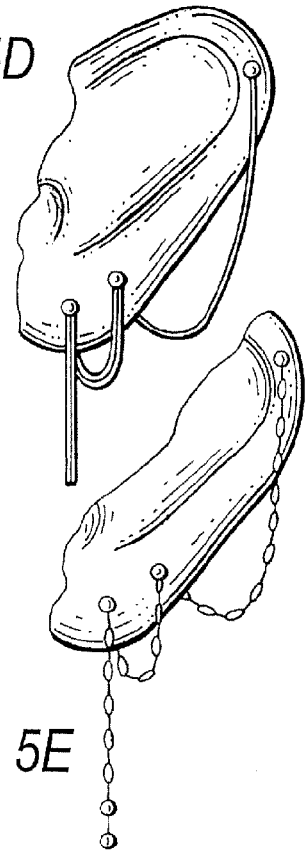
FIG. 5E
FIG. 5F
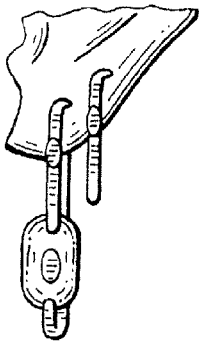
FIG. 5G
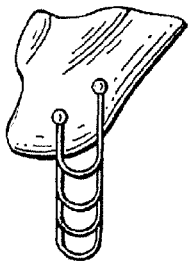
FIG. 5H
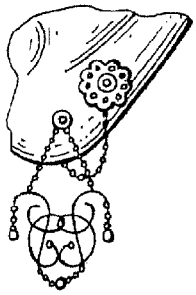
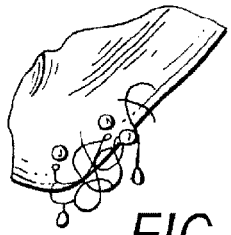
FIG. 5I
FIG. 5L
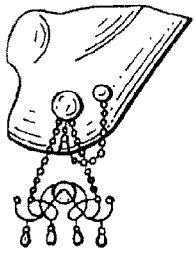
FIG. 5J
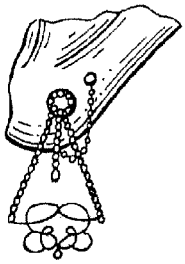
FIG. 5K
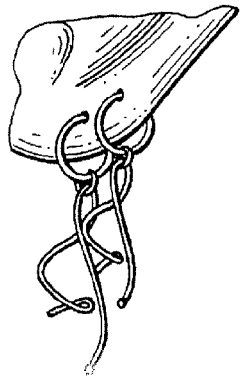
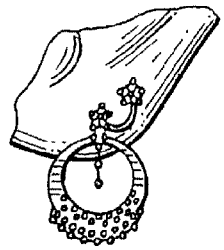
FIG. 5M

SINGLE EARRING SET FOR DOUBLE PIERCED EARS

This application claims benefit of provisional application No. 60/810,795 filed Jun. 2, 2006.

BACKGROUND OF THE INVENTION

This invention relates generally to the field jewelry and, more particularly, to a single earring set for double pierced ears.

Prior art earring designs do not employ a flowing "design" from front to back (or back to front), nor do they employ a plurality of sections interconnected through a plurality of pierced holes on the ear lobe. Prior art designs cannot accommodate the positioning of a wearer's pierced holes on the earlobe since they are often connected to the next hole by a rigid bar or employ what is known as a "pull-through" design. This inhibits flexibility in use, rendering prior art earring designs less than advantageous.

SUMMARY OF THE INVENTION

Generally speaking, in accordance with the invention, an earring assembly for a doubled pierced ear is provided. The assembly includes a first element comprising a first linkage, a middle element comprising a second linkage and third element comprising a third linkage. The first linkage of the first element has first and second ends. Similarly, the second linkage of the middle element has first and second ends and the third linkage of the third element has first and second ends.

Significantly, one of the ends of the first and second linkages includes a first earring post. Moreover, one of the ends of the second and third linkages includes a second earring post. These earring posts are selectively coupled to a backing element provided along the adjacent linkage end in order to attach the inventive earring assembly to an ear lobe.

Accordingly, it is an object of the invention to provide an improved earring assembly for doubled pierced ears.

Still another object of the invention is to provide an earring assembly for doubled pierced ears employing a flowing design from front to back, or from back to front.

A further object of the invention is to provide an earring assembly for doubled pierced ears which accommodates the positioning of the wearers pierced holes along his or her ear lobe.

Yet another object of the invention is to provide an improved earring assembly for doubled pierced ears that provides enhanced flexibility in arrangements during attachment to an earlobe.

BRIEF DESCRIPTION OF THE DRAWINGS

For a fuller understanding the invention, reference is made to the following description, taken in connection with the accompanying drawings in which:

FIGS. 4A-4O are plan views showing various embodiments of the inventive earring assembly; and FIGS. 5A-5M are plan views showing further embodiments of the inventive earring assembly.

DETAILED DESCRIPTION

Figure 1:
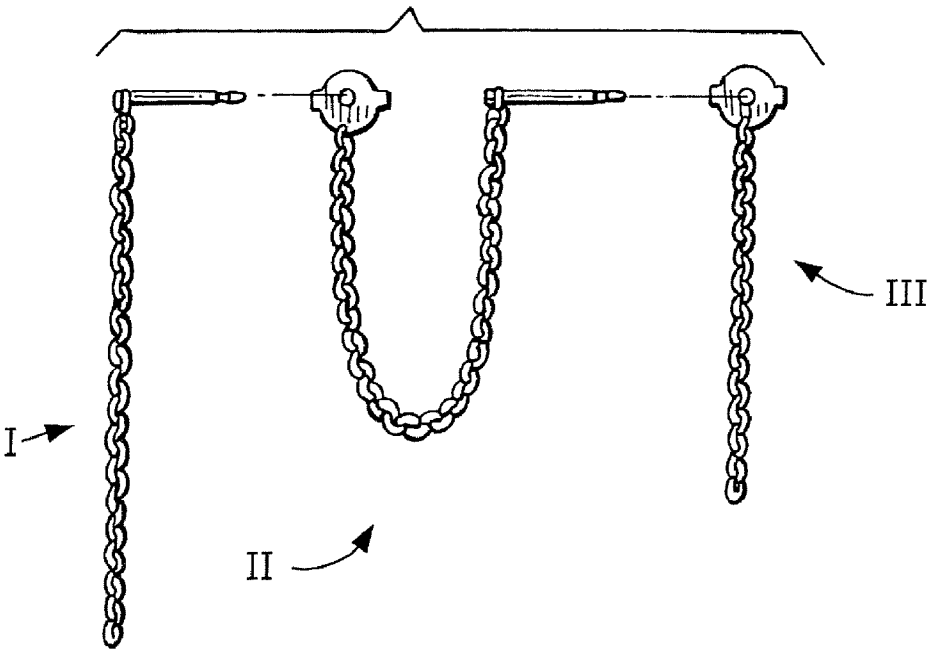
FIG. 1 is a plan view of the component parts of the inventive earring assembly.

In FIG. 1 of the accompanying drawings, it is shown that the present invention is a single earring set that comprises of three separate Sections: Section I, Section II, and Section III.

Figure 2:
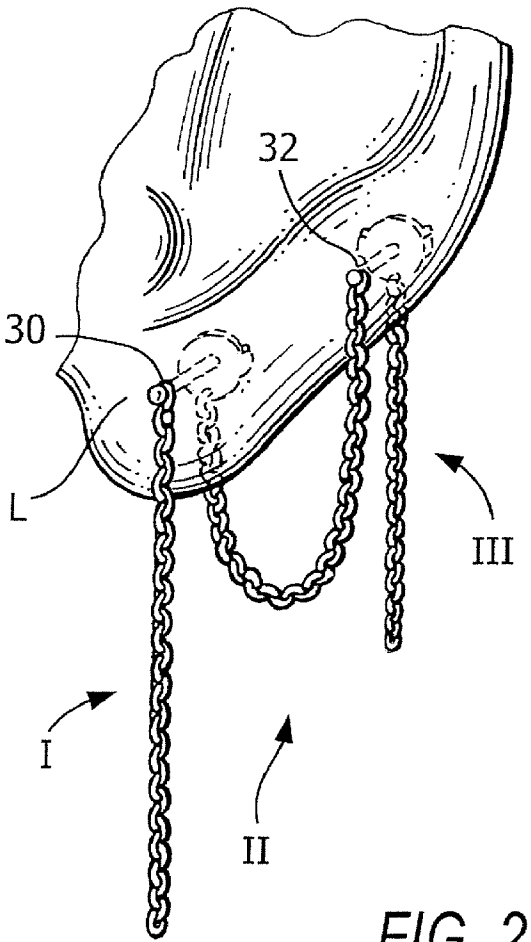
FIG. 2 is front elevational view showing one embodiment of the inventive earring assembly being worn along an earlobe.

Referring to FIG. 2, it is shown that the three separate sections 1, 2, 3 are worn on an earlobe L having two pierced holes, a first pierced hole 30 and a second pierced hole 32, in such a manner that it creates a visual impression that it is a single-piece earring which pierces through, or "threads through," the earlobe, while in fact Section I is connected to Section II, and Section II is connected to Section III, as described in more detail herein.

Referring now to FIG. 3 and FIGS. 3A, 3B and 3C, in a preferred embodiment of the present invention: Section I has an ornamental dangle C, a linkage or chain B, and an earring post A to be accepted and held by earring back D of Section II; Section II has an earring back D for receiving the earring post A from Section I, a linkage or chain E, and an earring post F to be accepted and held by earring back G of Section III; Section III has an earring back G, a linkage or chain H, and an ornamental dangle J.

Figure 3:
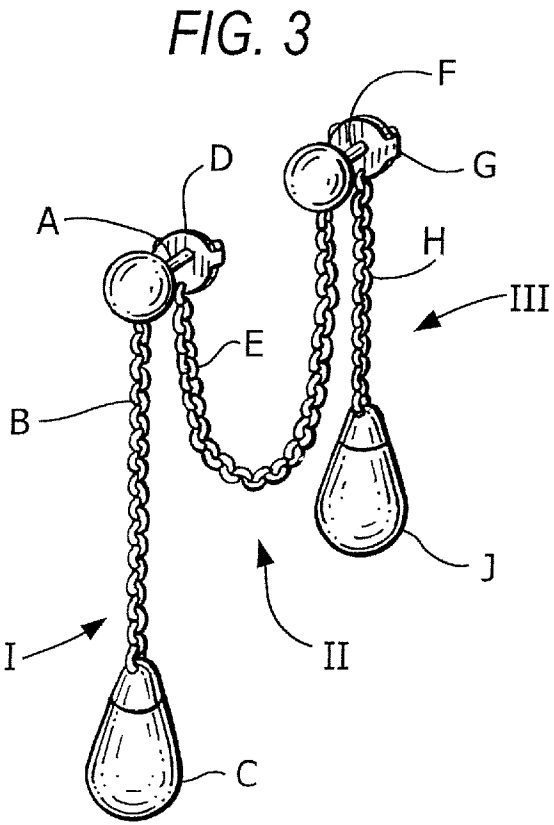
FIG. 3 is an enlarged perspective view showing the component parts of the inventive earring assembly in an interconnected condition.
Figure 3A:
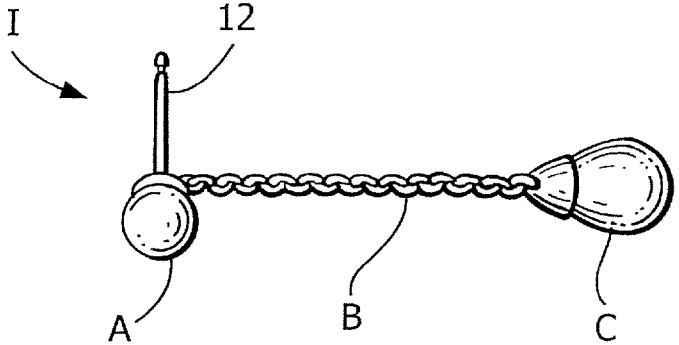
FIGS. 3A, 3B and 3C are plan views showing the individual component parts of the inventive earring assembly.
Figure 3B:
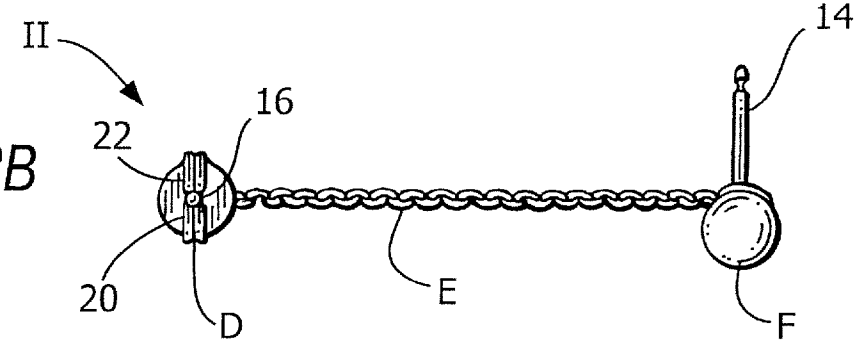
Figure 3C:
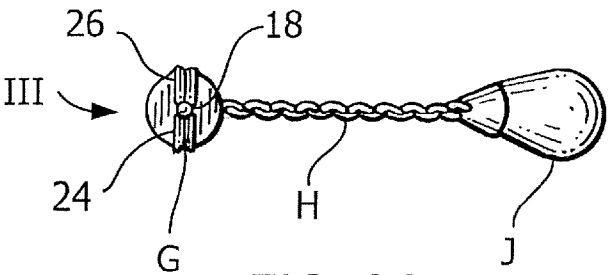

Referring to FIGS. 2 and 3, Section I is connected to Section II in the following manner. First, the earring post A of Section I is inserted through the first pierced hole 30 on the earlobe L, and locked in place by the earring back D of Section II. More specifically, the earring back D of Section II has an opening 16 formed therethrough for accepting and holding earring post A of Section I. Such use of a post and back for holding earrings in the pierced hole of an earlobe are widely and generally known to those skilled in the art and to those persons who wear pierced earrings. Piercing of an earlobe is necessary in order to wear a two-piece post-back earring. The central opening 16 is of such breath as to receive snugly therein the earring post A and to hold the earring post A therein by friction realized between the earring back D acting on the earring post A. In a preferred embodiment of the present invention, the earring post A is provided with a circular groove 12 at the end thereof which receives certain portions 20, 22 of the earring back D, as is generally understood by those of ordinary skill in the jewelry designing art. When Section 1 is connected to Section II in this manner, the ornamental dangle C of Section I is placed in front of the earlobe (i.e., on the side of the earlobe facing forward), and the chain B of Section II is placed at the back of the earlobe.

Also referring to FIGS. 2 and 3, Section II is connected to Section III in a similar manner. First, the chain E of Section II is brought from the back of the earlobe F to the front of the earlobe. Then, the earring post F of Section II is inserted through the second pierced hole 32 on the earlobe, and locked in place by the earring back G of Section III. More specifically, the earring back G of Section III has a central opening 18 formed therethrough. The central opening 18 is of such breadth as to receive snugly therein the earring post F and to hold the earring post F therein by friction realized between the earring back G acting of the earring post A. In a preferred embodiment of the present invention, the earring post F is provided with a circular groove 14 at the end thereof which receives certain portions 24, 26 of the earring back G, as is generally understood and practiced by those of ordinary skill in the jewelry designing art. When Section II is connected to Section III in this manner, the chain E of Section II loops, or arcs around the bottom portion of the earlobe L, and the ornamental dangle J of Section III is placed at the back of the earlobe. Since Section II is separately connected to Section I and Section III in the manner described above, the design in accordance with the present invention allows for one earring design to be worn in multiple ways as well as being interchangeable with other earrings. The use of separate Section II for the specific design purpose as described herein has never been disclosed in any prior art reference in the field of earring design.

When Sections I, II and III are connected together as described above, the present invention allows the wearer to employ unlimited design possibilities. For instance, the ornamental dangles C and I of Section I and Section III, respectively, may be diamonds, rubies, sapphires, pearls, etc., of different shapes and sizes. Likewise, the chains B, E and H of Section I, Section II and Section III, respectively, may be metal chain, link, links, and the like, made of gold, platinum gold, silver, bronze, etc., of different shapes and configurations.

Referring to FIGS. 4A-4O, there is shown alternative embodiments of the present invention, including earring sets in accordance with the present invention being worn in reverse order, i.e., from back to front, rather than from front to back.

Referring to FIGS. 5A-5M, there is shown various alternative embodiments of the present invention, including earring sets in accordance with the present invention being worn on an earlobe having three pierced holes (FIGS. 5D and 5E). Likewise, a person of ordinary skill in the art of jewelry design would easily envision that an earring set in accordance with the present invention may be worn on an earlobe having more than three pierced holes, with additional Section(s).

In fact, FIGS. 4A-4O and 5A-5M show different ways in which the various constituent elements (or Sections) in accordance with the present invention may be worn on an earlobe with a plurality of pierced holes. FIGS. FIGS. 4A-4O and 5A-5M are not exhaustive in terms of the possible variations of interconnecting the separate elements (or Section) of the earring set in accordance with the present invention. A person of ordinary skill in the art of jewelry design—once her or she has been apprised of the inventive concept of the present invention—would be able to envision variations other than the exact depictions as shown in FIGS. FIGS. 4A-4O and 5A-5M.

In conclusion, the earring design in accordance with the present invention is far superior to any of the previously known design concepts—e.g., U.S. Pat. Nos. D410,589; 4,086,786; 6,014,870; D376,768; 4,489,572; and D348, 023—in that none of the previously known earring designs employs a "flowing design" from front to back (and, in an alternative embodiment, from back to front), with a plurality of Sections interconnected through a plurality of pierced holes on an earlobe. For instance, the earring design in accordance with the present invention can accommodate the positioning of a wearer's pierced holes on an earlobe, since they are not connected to the next hole by a rigid bar, but by a plurality of flexible elements, such as a chain, links, beads, etc. Moreover, the present invention does not employ a "pull-through" design. Instead, the constituent elements of the earring set in accordance with the present invention are derived from an earring design which incorporated a plurality of holes through standard posts and backs while using a variety of materials and stones of different shapes and sizes to connect them from front to back (and from back to front). As such, the earring design in accordance with the present invention allows great flexibility and endless possibilities in terms of how the pieces (i.e., Sections) are interconnected together and its ability to incorporate different precious stones, metals, gems, and the like, of different shapes and sizes.

While certain novel features of this invention have been shown and described, it will be understood that various modifications, omission, substitutions and changes in the forms and details of the device illustrated and in its operation can be made by those skilled in the art without departing from the spirit and scope of the invention.

The scope of the invention is indicated in the following claims.

The invention claimed is:

1. An earring assembly for a double pierced ear comprising:

a first element comprising a first linkage having first and second ends;

a second element comprising a middle linkage having first and second ends;

a third element comprising a third linkage having first and second ends;

wherein one of said first linkage second end and middle linkage first end has a first earring post;

wherein one of said middle linkage second end and third linkage first end has a second earring post;

wherein the other of said first linkage second end and middle linkage first end has a back for selectively mating with said first post; and wherein the other of said middle linkage second end and third linkage first end has a back for selectively mating with said second post.

2. The assembly of claim 1, wherein each of said linkages comprises a chain.

3. The assembly of claim 2, wherein said middle linkage comprises a flexible chain.

4. The assembly of claim 3, wherein all of said linkages comprises flexible chains.

5. The assembly of claim 4, wherein said first linkage second end has said first post and said middle linkage second end has said second post.

6. The assembly of claim 5, wherein said middle linkage first end has a back for selectively mating with said first post and wherein said third linkage first end has a back for selectively mating with said second post.

7. The assembly of claim 6, wherein said first linkage first end includes a first ornament and said third linkage second end includes a second ornament.

8. The assembly of claim 7, wherein said first ornament and said second ornament are dangling ornaments.

9. The assembly of claim 5, wherein said first ornament has a visual presentation that is complementary to the visual presentation of said second ornament.

10. The assembly of claim 9, wherein said first and second ornaments are the same in design.

11. The assembly of claim 1, wherein each of said backs is formed with an opening for selectively accepting said first and second earring posts respectively.

12. The assembly of claim 11, wherein each of said posts includes a groove for selectively engaging with cooperating portions of said corresponding backs.

13. A method for assembling a jewelry earring on an earlobe of an ear comprising the steps of:

forming first and second pierced holes in said earlobe;

inserting a first earring post located at one end of a first jewelry linkage through said first pierced hole;

locking said first post in place by mating said first post with a first back located at one end of a second jewelry linkage;

inserting a second earring post located at the other end of said second jewelry linkage through said second pierced hole; and locking said second post in place by mating said second post with a second back located at one end of a third jewelry linkage.

14. The method of claim 13, wherein the earlobe has a front and a rear, and wherein said first post inserting step comprises inserting said first post from the front of said earlobe and through said first pierced hole.

15. The method of claim 14, wherein said first post locking step comprises mating said first post with said first back along the rear of said earlobe following the step of inserting said first post through said first pierced hole.

16. The method of claim 15, further including the step of running said second jewelry linkage from the rear of said earlobe to the front of said earlobe following the mating of said first post with said first back and prior to inserting said second post through said second pierced hole.

17. The method of claim 16, wherein said second post inserting step comprises inserting said second post from the front of said earlobe and through said second pierced hole.

18. The method of claim 17, wherein said second post locking step comprises mating said second post with said second back along the rear of the earlobe following the step of inserting the second post through said second pierced hole.

19. An earring assembly for a double pierced ear comprising:

a first element comprising a first linkage having first and second ends;

a second element comprising a middle linkage having first and second ends;

a third element comprising a third linkage having first and second ends;

wherein one of said first linkage second end and middle linkage first end has a first earring post;

wherein one of said middle linkage second end and third linkage first end has a second earring post;

wherein each of said linkages comprises a chain;

wherein all of said linkages comprises flexible chains;

wherein said first linkage second end has said first post and said middle linkage second end has said second post; and wherein said middle linkage first end has a back for selectively mating with said first post and wherein said third linkage first end has a back for selectively mating with said second post.

20. The assembly of claim 19, wherein said first linkage first end includes a first ornament and said third linkage second end includes a second ornament.

* * * * *